United States Patent [19]

Magnie

[11] 4,265,309

[45] May 5, 1981

[54] EVALUATION AND PRODUCTION OF ATTIC OIL

[75] Inventor: Robert L. Magnie, Denver, Colo.

[73] Assignee: Ruel C. Terry, Denver, Colo.

[21] Appl. No.: 85,532

[22] Filed: Oct. 17, 1979

[51] Int. Cl.[3] ..... E21B 43/18; E21B 47/00

[52] U.S. Cl. ..... 166/252; 166/263; 166/305 R

[58] Field of Search ..... 166/250, 252, 253, 254, 166/263, 268, 303, 305 R

[56] References Cited

U.S. PATENT DOCUMENTS

| | | | |
|---|---|---|---|
| Re. 24,873 | 9/1960 | Lindauer, Jr. | 166/268 |
| 1,872,906 | 8/1932 | Doherty | 166/254 X |
| 2,548,059 | 4/1951 | Ramsey | 166/268 X |
| 3,705,625 | 12/1972 | Whitten et al. | 166/252 |
| 3,814,186 | 6/1974 | Allen | 166/272 |
| 3,987,853 | 10/1976 | Allen | 166/272 |

OTHER PUBLICATIONS

Morrow, R. M., "Undip Oil Recovery by Downdip Gas Injection", *The Petroleum Engineer,* Apr. 1957, pp. B-28 to B-32.

Bleakley, W. B., *The Oil and Gas Journal,* Nov. 13, 1967, pp. 132-134.

Strickland, R. F., et al., "Gas Injection for Upstructure Oil Drainage", *Journal of Petroleum Technology,* Oct. 1979, pp. 1323-1331.

*Primary Examiner*—James A. Leppink
*Assistant Examiner*—George A. Suchfield
*Attorney, Agent, or Firm*—Ruel C. Terry

[57] ABSTRACT

In a dipping underground petroleum reservoir devoid of a natural gas cap, a mixture of gases soluble in petroleum is injected into a well positioned in an up dip location. Gases in the mixture are selected for their diverse solubility and diffusion characteristics. Gas injection is terminated followed by attic oil production wherein the gases accompanying the produced oil are separated and measured. The separated gases are then compared quantitatively with gases injected and the solubility capabilities of the produced oil. Results are used to estimate the size of the attic portion of the reservoir. Alternating cycles of gas injection and attic oil production are continued until the well is engulfed by the expanding artificial gas cap.

6 Claims, 2 Drawing Figures

EVALUATION AND PRODUCTION OF ATTIC OIL

FIELD OF THE INVENTION

This invention relates to the recovery of petroleum from an underground, dipping reservoir. More particularly the invention teaches injection of selected gases into an existing production well, located in an up dip position, first to evaluate the size of the petroleum reservoir located still further up dip and second to provide a method of producing oil from the so-called attic portion of the reservoir.

BACKGROUND OF THE INVENTION

The present invention extends the teachings of my co-pending application for patent, Ser. No. 947,344, filed Oct. 2, 1978, now U.S. Pat. No. 4,183,405 which is incorporated herein by reference.

Petroleum reservoirs commonly are located underground in porous, permeable rock strata. Due to tectonic activity the petroleum reservoir frequently is inclined with respect to the horizontal. The petroleum itself is trapped in the pore space of the host rock, generally having arrived at its trapped position by displacing remnants of an ancient ocean. Under these conditions the up dip limits of the petroleum reservoir are defined by a blockage such as a permeability pinch-out or a fault. The down dip limit of the reservoir generally is the displaced salt water and such limit is commonly called the oil/water contact. The oil/water contact generally is located in a transition zone of the reservoir, such transition zone being positioned roughly parallel to the horizontal. The up dip limit of the reservoir often is quite irregular and its exact location uncertain, such location being known only to the extent that it lies between a producing well and a dry hole. The up dip limit may lie near the producing well, near the dry hole or some point in between.

Generally each oil producing province in the United States has well spacing regulations that establish drilling patterns for the petroleum reservoir. Such spacing generally is uniform for the entire reservoir, with one reservoir assigned a 40 acre spacing, another a 160 acre spacing, and the like. For a 40 acre spacing each well drilled would be one fourth of a mile from adjacent wells, and for 160 acre spacing the wells would be a half mile apart.

Looking now to development drilling of a newly discovered dipping oil reservoir in which the state regulatory agency has set for 160 acre spacing, step out drilling continues until the maximum limits of the reservoir are substantially defined. In the usual case, step out drilling results in several dry holes, the wells being designated dry in the sense that they are incapable of producing petroleum in commercial quantities. Step out drilling in a down dip direction ultimately will result in a well being drilled below the oil/water contact, a dry hole capable of producing brine. Step out drilling in both strike directions ultimately will result in at least two dry holes which are located beyond permeability pinch-outs or faults that define the lateral extent of the reservoir. Step out drilling in an up dip direction from a series of producing wells located on strike often results in some wells becoming producers and others being dry holes, presenting the operator with somewhat of a paradox.

A prudent operator will not continue to drill a well pattern that appears to be located below the oil/water contact. Even if some of the wells might be producers, their life would be short as the oil/water contact moves up dip during continuing production. Such oil as might have been produced under these conditions generally can be poroduced at a later time through existing production wells positioned up dip. The operator also will refrain from drilling additional wells suspected to be beyond the lateral extent of the reservoir. The row of wells up dip, some producers and some dry holes, are of particular concern when the reservoir is devoid of a natural gas cap. Each dry hole in the row of wells up dip provides positive information about the up dip limits of the reservoir: the limit is somewhat between the dry hole and the corresponding producer down dip. The producer wells in the row of wells up dip are obviously in the reservoir, with the limit of the reservoir at some location further up dip. The operator then is faced with the decision of whether or not to offset a producing well with a new well drilled at the next up dip location, recognizing the high risk of drilling a dry hole. It would be quite helpful to the operator if there were a method to measure the up dip extent of the reservoir without incurring the expense of drilling additional dry holes. It is one object of the present invention to teach such methods.

At each producer well located near the dip extremity of the reservoir, there is an unknown amount of petroleum located between the producer and the up dip limit of the reservoir. This unknown amount of petroleum will remain locked in place when the water drive advances up dip to the well location and causes the producer well to water out and thus no longer be a producer of petroleum in commercial quantities. This petroleum locked in place in the attic could be produced with a newly drilled well positioned off pattern near the upper limit of the reservoir. Siting such off pattern well is a risky undertaking which requires special approval from the state regulatory agency, approval that may or may not be forthcoming. The petroleum locked in place, sometimes called attic oil, often involves 100,000 barrels or more, and thus its recovery generally is a worthwhile effort.

During recent years many schemes have been tried in the quest for recovery of attic oil. One method, previously mentioned, is to drill off pattern wells. This method requires precision well siting, and even then some oil will remain in the attic. A less risky method involves creating an artificial gas cap that converts a portion of the reservoir to a combination water drive/gas drive. In the early stages of trying this method, generally there was an abundant nearby supply of low value natural gas. The natural gas was injected into one or more up dip production wells at such pressure needed to overcome the water drive pressure. Upon continuing injection of natural gas in this manner, attic oil would take natural gas into solution until becoming saturated, then surplus natural gas would form an ever increasing gas cap. Eventually the gas cap would expand to such an extent that the attic would be, in effect, composed of a gas cap. Under the influence of a gas drive, recoverable attic oil would be produced by pressure relief into a down dip production well. This method relies on the availability of natural gas and has the disadvantage of leaving a substantial amount of natural gas in the attic.

In recent times the value of natural gas has increased dramatically and regulatory agencies have established priorities for its use. Currently there are many instances where natural gas, although produced in the area, is not available for use in creating an artificial gas cap in a petroleum reservoir. There are, however, many other gases that are suitable for taking into solution in attic petroleum to form an artificial gas cap and a gas drive to the reservoir. Some promising candidates include carbon monoxide, carbon dioxide and nitrogen, all of which are readily available in the exhaust stream generated by the combustion of hydrocarbon fuels. There have been several attic oil production projects that have used products of combustion to create the desired artificial gas cap.

Products of combustion are particularly desirable when they are available in copious quantities as a by-product of another operation, such as the exhaust from internal combustion engines that drive a battery of compressors. These gases are normally vented to the atmosphere together with the water vapor that also is a product of combustion. These gases may be diverted to attic oil production, although they are not readily usable without further processing. Since the gases must be compressed to pressures exceeding that of the underground attic oil pressure, it is necessary that the water vapor be removed prior to compression. Also, during the combustion process in internal combustion engines some of the nitrogen from the intake air combines with oxygen to form nitrous oxide. With only 400 parts per million of nitrous oxide, a million standard cubic feet of inert exhaust gas can contain almost 50 pounds of nitric acid, an ingredient that must be substantially removed prior to compensation. Removal of water vapor is a relatively inexpensive undertaking, while removal of nitrous oxide is generally considerably more expensive. Nitrous oxide does not readily form at moderate temperatures of combustion, but is almost always found in the higher temperatures inherent in an internal combustion engine. Generating exhaust gases at moderate temperatures of combustion and thus avoiding formation of nitrous oxide is highly desirable as will be described hereinafter.

As is well known in the art a gas drive for petroleum performs better when the gases used are readily soluble in petroleum. The solubility capability of a medium grade crude oil at a reservoir pressure approximating 2000 psi at a temperature of 120° F. typically is, in standard cubic feet per barrel:

TABLE 1

| | |
|---|---|
| carbon dioxide | 1200 |
| natural gas | 660 |
| carbon monoxide | 83 |
| nitrogen | 70 |
| hydrogen | 68 |

Since the solubility of one gas is substantially unaffected by the presence of another, a considerable amount of crude dilution can be effected by injecting the suite of gases listed in Table 1. As pointed out previously, natural gas may not be available for this purpose. Carbon dioxide, carbon monoxide and nitrogen can be made readily available at many sites as a product of combustion. Hydrogen, not normally a product of combustion derived from internal combustion engines, can be made available in a type of combustion involving coal as the fuel.

Coal deposits are common at sites overlying petroleum reservoirs, and thus there are many cases where combustion of coal can be used to generate gases useful in the production of attic oil. Coal can be gasified in an aboveground generator such as the well known Lurgi system or it may be generated from coal in situ. In both cases temperatures are in the moderate range, generally eliminating the formation of the undesirable nitrous oxide when combustion is attained using air as the oxidixer. The producer gas generated, on a volumetric dry basis, typically is:

TABLE 2

| | Aboveground | In Situ |
|---|---|---|
| hydrogen | 10.5 | 17.2 |
| carbon monoxide | 22.0 | 14.7 |
| carbon dioxide | 5.7 | 12.4 |
| nitrogen | 58.8 | 51.0 |
| methane plus | 3.0 | 4.6 |

All of the gases listed in Table 2 are readily soluble in attic oil. This suite of gases can find a useful purpose in establishing a gas drive in attic oil and, upon continuing injection, in the creation of an artificial gas cap.

For the purpose of measuring the size of the attic, the diffusion characteristics of gases listed in Table 2 provide a useful tool. Diffusion properties of the suite of gases where the diffusion rate of carbon dioxide is taken at unity may be expressed as:

TABLE 3

| | |
|---|---|
| carbon dioxide | 1.0 |
| carbon monoxide | 1.6 |
| nitrogen | 1.6 |
| methane | 1.5 |
| hydrogen | 22.0 |

Hydrogen, with its relatively low solubility capability, can be expected to move relatively rapidly through the petroleum reservoir with continued injection of the suite of gases. It is this special characteristic of hydrogen that is of interest in measuring the approximate size of the attic. It will be appreciated that this invention is not limited by an theory of operation, but any theory that has been advanced is merely to facilitate disclosure of the invention.

It will be appreciated that all gases listed in Tables 1, 2 and 3 will, upon injection into the petroleum reservoir, first become partially dissolved into the petroleum, then begin to migrate to the highest permeable point in the reservoir. Gases with low diffusion rates will tend to supersaturate the up dip petroleum in the immediate vicinity of the injection well, while hydrogen will tend to diffuse in an up dip direction before full saturation is attained. Upon continued injection of the suite of gases, a gas cap will form beginning at the up dip limits of the reservoir and expanding down dip. Thus production wells in the updip portion of the reservoir can be produced under the influence of the gas drive created by the artificial gas cap, and after a period of time will cease to produce oil when they become engulfed by the expanding gas cap. Likewise the production wells in the down dip portion of the reservoir can be produced under the influence of the water drive until they become engulfed by the advancing water.

SUMMARY OF THE INVENTION

In an underground petroleum reservoir that is devoid of a gas cap, a gas mixture is injected into the petroleum in order to provide a means of estimating the quantity of attic oil and in order to provide a means of producing the attic oil. Gases are selected with differing solubility rates and varying diffusion rates to facilitate attic oil quantity estimates and to provide an artificial gas drive in the reservoir.

DESCRIPTION OF THE PREFERRED EMBODIMENT

For illustrative purposes a petroleum reservoir is described at a depth of approximately 5,000 feet, with an average reservoir pressure of 2,000 psi and a reservoir temperature of approximately 120° F. The reservoir is relatively porous and permeable with an average porosity of 25% and an average permeability of 700 md. The crude oil has a gravity of 25° API at 60° F. Well spacing is 160 acres. The reservoir has no natural gas cap and the oil is trapped in place by a water drive.

Figure 1:
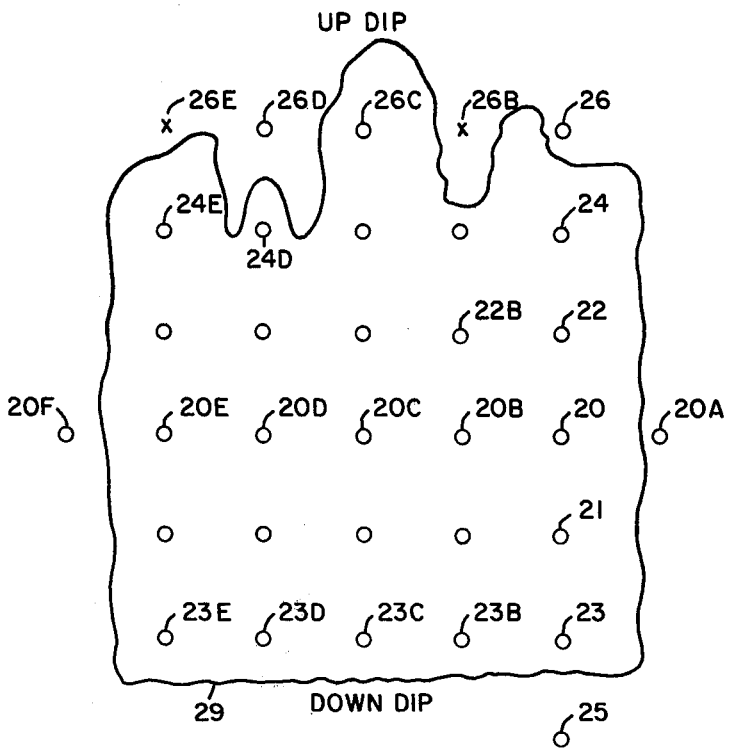
FIG. 1 is a diagrammatical plan view of a well pattern into an underground petroleum reservoir showing the relationship of the various wells for the methods of the invention.

Referring first to FIG. 1, discovery well 20 was first drilled into the reservoir, indicating the possibility of a commercial reservoir. Well 20A was drilled next and resulted in a dry hole. Offset wells 22, 20B and 21 were then drilled as producers, offering encouragement about the potential size of the reservoir. Continuing offset drilling down dip resulted in producer 23 and dry hole 25. Well 25 encountered salt water indicating a water drive on the reservoir and giving an approximation of the down dip limits of the reservoir. Continuing off set drilling on strike resulted in producers 20C, 20D, and 20E. Well 20F was a dry hole which together with well 20A indicated the lateral extent of the reservoir.

Continuing offset drilling up dip resulted in producer 24 and dry hole 26. Then by stepping out two locations laterally, 26C is a producer, followed by offset location 26D which was a dry hole. Coming down dip well 24D was a producer as was lateral offset well 24E. At this stage in the drilling program, the operator knows there is attic oil up dip from wells 24, 26C, 24D and 24E, and that a gas cap probably is not present. The operator could drill locations 26B and 26E and gain additional information about the up dip limits of the reservoir, although from the information at hand such drilling would be highly risky.

Figure 2:
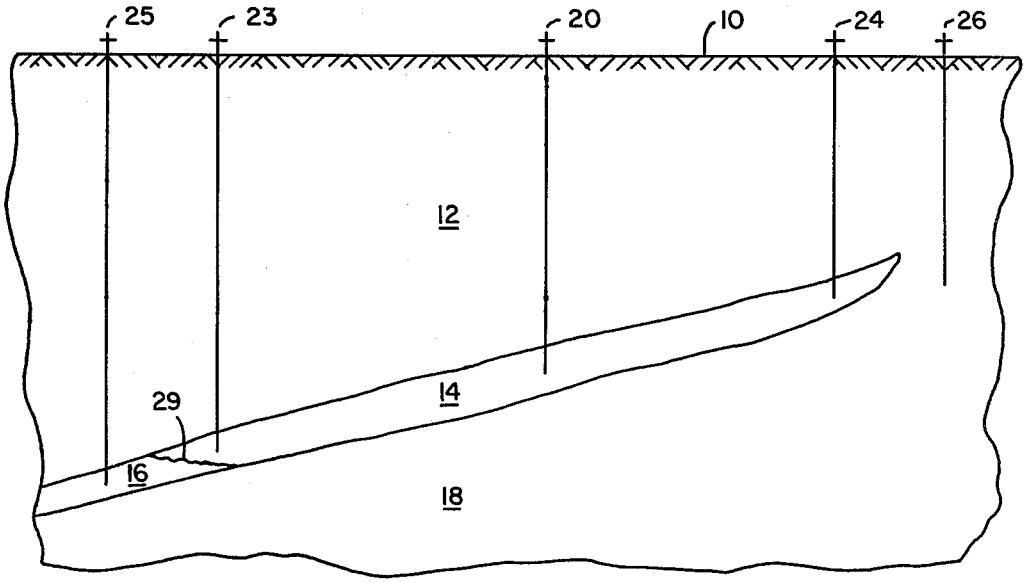
FIG. 2 is a diagrammatical vertical section taken through a portion of the earth showing selected wells drilled into the underground petroleum reservoir.

Referring to FIG. 2, well 25 is known to be in salt water 16 down drip from oil/ water contact 29. Wells 23B, 23C, 23D and 23E are above the oil/ water contact but can be expected to have a relatively short productive life as production continues and oil/ water contact 29 advances up dip under the influence of the water drive. The row of wells in the 21 series will have longer productive life, the row of wells in the 20 series still longer.

It should be noted that the dip of the petroleum reservoir is established by the geological data accumulated during drilling of the various wells from the surface of the earth 10 through overburden 12 into reservoir 14, with some of the wells penetrating underburden 18. The down dip limit of the reservoir becomes apparent through the production history of wells in the 23 series. The up dip limit of the reservoir is known only to the extent that it is irregular. Irregularity in a petroleum reservoir frequently is caused by unpredictable shale deposition, such shale filling the porosity of the host rock.

Since it is highly desirable to produce the up dip attic oil, it is preferred that a suite of gases be injected into the up dip wells to establish a gas drive in this portion of the reservoir. Preferably the suite of gases is derived from the gasification of coal, either in above ground facilities or by in situ techniques. The preferred producer gas is dehydrated, then compressed to a pressure sufficient for injection into the underground reservoir, for example 2,500 psi. The producer gas will be a mixture as shown in Table 2 above, and will have the diffusion characteristics as shown in Table 3 above. It is further preferred that the up dip well selected to be used for initial trials of gas injection, be a well that is suspected to be down dip from a relatively small attic.

Looking first to well 24D, producer gas is, for example, injected at a rate of three million standard cubic feet per day for a period of 10 days. The well then is shut in for a short period of time, for example two days, to allow injected gas to continue diffusing, both upward and laterally, while localized high pressures are seeking stabilization. Well 24D is then returned to oil production with the dissolved gases being measured upon coming out of solution in surface facilities and measuring the quantity of attic oil produced from this updip well. Desired measurements include volume of total gas recovered together with volumetric percentages of each gas in the mixture. Oil production continues, for example, at the rate of 500 barrels per day for 10 days. With the volume of injected gases totalling 30 million standard cubic feet, followed by 5,000 barrels of oil production, gas measurements at surface facilities typically could be:

TABLE 4

| | Recovered, scf | Injected, scf | Solubility cap. of attic oil, scf |
|---|---|---|---|
| Hydrogen | 85,000 | 3,150,000 | 340,000 |
| Carbon monox. | 400,000 | 6,600,000 | 415,000 |
| Carbon diox. | 800,000 | 1,710,000 | 6,000,000 |
| Nitrogen | 600,000 | 17,640,000 | 350,000 |

Comparing gas recovered, gas injected and the solubility capaicity of the produced oil, only one gas—nitrogen—is indicated to be supersaturated in the produced oil when the oil is positioned in the reservoir. Supersaturation of nitrogen is not unexpected in view of the volume injected, its slow diffusion rate and the relatively short time span for diffusion to occur. The relatively low saturation of hydrogen, with its unusually high diffusion rate, indicates a considerably larger volume of attic oil remaining unproduced.

It is desirable that the injected gases be given sufficient time to complete their natural diffusion through the reservoir. Accordingly, without further injection of the suite of gases into well 24D, the well is shut in for a longer period of time, for example, two weeks. Production of oil is then resumed, for example, at a rate of 500 barrels per day for 20 days. During this production run, gas measurements at surface facilities typically could be:

TABLE 5

| | Recovered, scf | Attic oil capacity, scf |
|---|---|---|
| Hydrogen | 600,000 | 680,000 |
| Carbon monoxide | 750,000 | 830,000 |
| Carbon dioxide | 800,000 | 12,000,000 |

TABLE 5-continued

| | Recovered, scf | Attic oil capacity, scf |
|---|---|---|
| Nitrogen | 700,000 | 700,000 |

This production run indicates that a substantial amount of the attic oil within the influence of this well has been recovered, and that an artificial gas cap has been created. It will be noted that most of the carbon dioxide has been accounted for, that the produced crude oil is saturated with nitrogen and substantially saturated with carbon monoxide and hydrogen. It may be deduced that a good portion of the unaccounted for nitrogen, carbon monoxide and hydrogen have consolidated as a mixture forming the artificial gas cap.

During the gas injection phase, the bottom hole pressure in well 24D could be expected to increase in the order of 200 psi. At the conclusion of the second production run, the bottom hole pressure will decrease to a pressure, for example, of 50 psi above that of the original bottom hole pressure. Under these conditions it could be expected that another 5,000 barrels of attic oil could be produced under the influence of the gas drive. The operator can test these expectations by resuming oil production in well 24D while continuing to monitor produced gas. Supersaturation of any of the gases during continued production indicates that the expanding gas cap is nearing the well. If supersaturation is not observed prior to bottom hole pressure reduction to the original reservoir pressure, gas injection should be resumed with alternating cycles of gas injection and attic oil production, until economically recoverable oil is produced from the attic and the welll is engulfed by the expanding gas cap.

Petroleum reservoirs vary widely from oil field to oil field, thus it is generally necessary to produce a particular reservoir over a representative time period in order to forecast reservoir performance in the future. With the production experience gained in producing well 24D as described in the foregoing, the operator can proceed to wells 24E, 26C and 24 for alternate gas injection and attic oil production. With a relatively few cycles at wells 24E, 26C and 24, the operator can forecast a rather sizable attic oil production from these wells. Based on these forecasts the operator can justify expansion of capacity for gas injection.

Thus it may be seen that a suite of gases may be injected into a dipping underground petroleum reservoir in order to produce attic oil and that by monitoring the quantities of gases injected compared to gases recovered during oil production, a reasonable estimate of attic size may be determined. While the present invention has been described with a certain degree of particularity it is understood that the present disclosure has been made by way of example and that changes in details of structure may be made without departing from the spirit thereof.

What is claimed is:

1. In a dipping underground petroleum reservoir devoid of a gas cap, wherein at least one well is located in an up dip portion of the reservoir, a method of estimating the size of the attic portion of the reservoir, comprising the steps of injecting a suite of gases into the said up dip well, measuring the quantity of each gas injected into the said reservoir in the said suite of gases, terminating injection of the said suite of gases, producing attic oil from thee said up dip well, measuring the quantity of attic oil produced from the said up dip well, separating the suite of gases recovered with the said produced oil, measuring the quantity of each gas in the said suite of gases separated from the said produced oil, then comparing the quantity of each gas in the said recovered and separated suite of gases with the quantity of each gas the said oil is capable of taking into solution when the said oil is positioned in the said reservoir.

2. The method of claim 1 wherein the said up dip well is shut in for a period of time after the said termination of gas injection and before initiating the said production of attic oil.

3. The method of claim 1 wherein the recited sequence of steps is repeated until the expanding artificial gas cap engulfs the said up dip well.

4. The method of claim 1 wherein the said suite of gases is composed of at least two gases selected from the group of gases comprised of hydrogen, carbon dioxide, carbon monoxide, nitrogen and methane.

5. The method of claim 1 further including the steps of terminating the said measuring the quantity of each gas in the said suite of gases separated from the said up dip well, terminating the said comparing the quantity of each gas in the said recovered and separated suite of gases with the quantity of each gas the said oil is capable of taking into solution when the said oil is positioned in the said reservoir, then establishing repetitive cycles of injecting the said suite of gases into the said up dip well and of producing the said attic oil from the said up dip well, until the said up dip well is engulfed by the expanding artificial gas cap.

6. The method of claim 5 wherein the said suite of gases is composed of at least two gases selected from the group of gases comprised of hydrogen, carbon dioxide, carbon monoxide, nitrogen and methane.

* * * * *